US006186782B1

(12) United States Patent
Luppi

(10) Patent No.: US 6,186,782 B1
(45) Date of Patent: Feb. 13, 2001

(54) ORAL CAVITY CLEANING DEVICE, PARTICULARLY FOR BEDRIDDEN PATIENTS

(75) Inventor: Libero Luppi, Mirandola (IT)

(73) Assignee: Starmed S.r.l., Mirandola (IT)

( * ) Notice: Under 35 U.S.C. 154(b), the term of this patent shall be extended for 0 days.

(21) Appl. No.: 09/404,580

(22) Filed: Sep. 24, 1999

(30) Foreign Application Priority Data

Oct. 14, 1998 (IT) ..... MI98A2214

(51) Int. Cl.[7] ..... A61C 1/10; A61C 17/06
(52) U.S. Cl. ..... 433/82; 606/161; 433/91
(58) Field of Search ..... 433/89, 90, 91, 433/92, 95, 80; 606/161

(56) References Cited

U.S. PATENT DOCUMENTS

| | | | | |
|---|---|---|---|---|
| 1,521,783 | | 1/1925 | Arhulfo . | |
| 1,983,601 | * | 12/1934 | Conn | 606/161 |
| 3,807,048 | * | 4/1974 | Malmin | 433/80 |
| 4,215,476 | * | 8/1980 | Armstrong | 433/95 |
| 4,672,953 | * | 6/1987 | DiVito | 433/91 |
| 4,863,380 | * | 9/1989 | Creed | 433/89 |
| 5,013,300 | * | 5/1991 | Williams | 433/91 |
| 5,061,180 | * | 10/1991 | Wiele | 433/95 |
| 5,098,291 | * | 3/1992 | Curtis et al. | 433/89 |
| 5,145,367 | * | 9/1992 | Kasten | 433/95 |
| 5,503,553 | * | 4/1996 | Hines | 433/80 |
| 5,573,398 | * | 11/1996 | Towle et al. | 433/80 |
| 6,030,215 | * | 2/2000 | Ellion et al. | 433/89 |

FOREIGN PATENT DOCUMENTS

| | | |
|---|---|---|
| 23 54 236 | 5/1975 | (DE) . |
| 92 08391 | 5/1992 | (WO) . |

* cited by examiner

*Primary Examiner*—Todd E. Manahan
(74) *Attorney, Agent, or Firm*—Guido Modiano; Albert Josif; Daniel O'Byrne

(57) ABSTRACT

An oral cavity cleaning device, particularly for bedridden patients, which comprises a body which has a grip portion connected to a front portion provided with bristles and the like, a channel provided inside the body with an opening at the bristles and an inlet which can be connected to an air suction unit, a container with a liquid located inside the channel, fluid tight means and internal ribs for peripherally supporting the container so as to form an annular region of the channel for the passage of fluid.

6 Claims, 2 Drawing Sheets

ORAL CAVITY CLEANING DEVICE, PARTICULARLY FOR BEDRIDDEN PATIENTS

BACKGROUND OF THE INVENTION

The present invention relates to an oral cavity cleaning device particularly for bedridden patients.

A currently strongly felt problem is cleaning the oral cavity of people who are necessarily bedridden and in any case cannot keep their head upright.

In such conditions there are considerable problems in emptying the oral cavity of the cleaning liquid and of the dirt particles.

In order to solve this problem, an oral cavity cleaning brush has already been introduced which is substantially constituted by a grip element which has bristles at one end and is internally provided with a through channel which ends at the bristles and is connected to a suction assembly which is connected to the other end of the grip.

This solution has proved to be valid in certain regards but it has the drawback that it is very troublesome to use, since it is necessary to introduce the cleaning liquid in the oral cavity using the other hand or perform the two operations at separate times.

Moreover, with this type of application it becomes troublesome to adjust the amount of liquid introduced in the oral cavity, with severe problems especially in the case of non-autonomous patients.

SUMMARY OF THE INVENTION

The aim of the present invention is to eliminate the above drawbacks, by providing an oral cavity cleaning device, particularly for bedridden patients, which allows to use just one hand to perform all the operations required for hygiene of the oral cavity of people who are not autonomous or are in any case unable to keep their head upright.

Within the scope of this aim, a particular object of the invention is to provide a device in which it is possible to introduce the cleaning liquid in the work area of the brush, being perfectly aware at all times of the amount of liquid administered.

Another object of the present invention is to provide an oral cavity cleaning device, particularly for bedridden patients, which, thanks to its particular constructive characteristics, is capable of giving the greatest assurances of reliability and safety in use.

Still another object of the present invention is to provide an oral cavity cleaning device, particularly for bedridden patients, which can be easily obtained starting from commonly commercially available elements and materials and is furthermore competitive from a purely economic point of view.

This aim, these objects and others which will become apparent hereinafter are achieved by an oral cavity cleaning device, particularly for bedridden patients, which comprises a body which has a grip portion connected to a front portion provided with bristles and the like, a channel being provided inside said body, said channel ending, at one end, with an opening at said bristles and, at the other end, with an inlet which can be connected to an air suction unit, characterized in that it comprises, inside said channel, a container of a liquid which can be operated from the outside of said body in order to spray said liquid at said opening.

BRIEF DESCRIPTION OF THE DRAWINGS

Further characteristics and advantages will become apparent from the description of a preferred but not exclusive embodiment of an oral cavity cleaning device, particularly for bedridden patients, illustrated only by way of non-limitative example in the accompanying drawings, wherein.

DESCRIPTION OF THE PREFERRED EMBODIMENT

Figure 2:
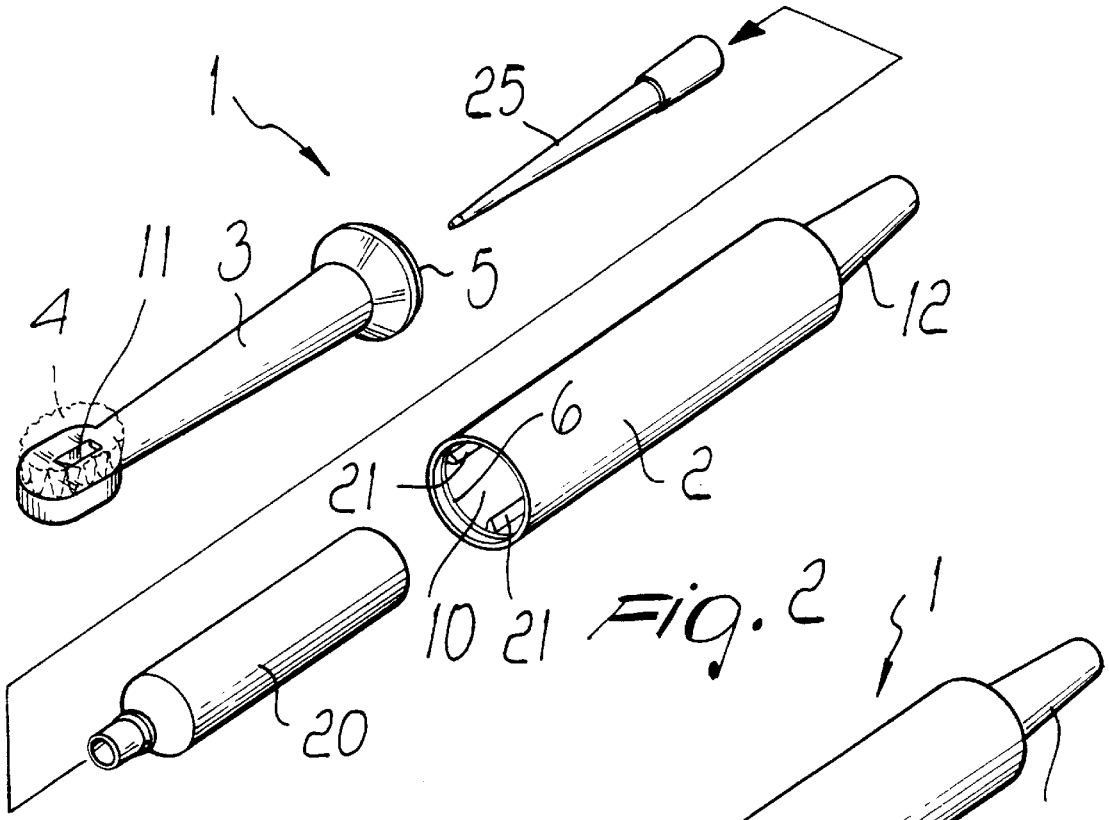
FIG. 2 is an exploded perspective view of the device.
Figure 1:
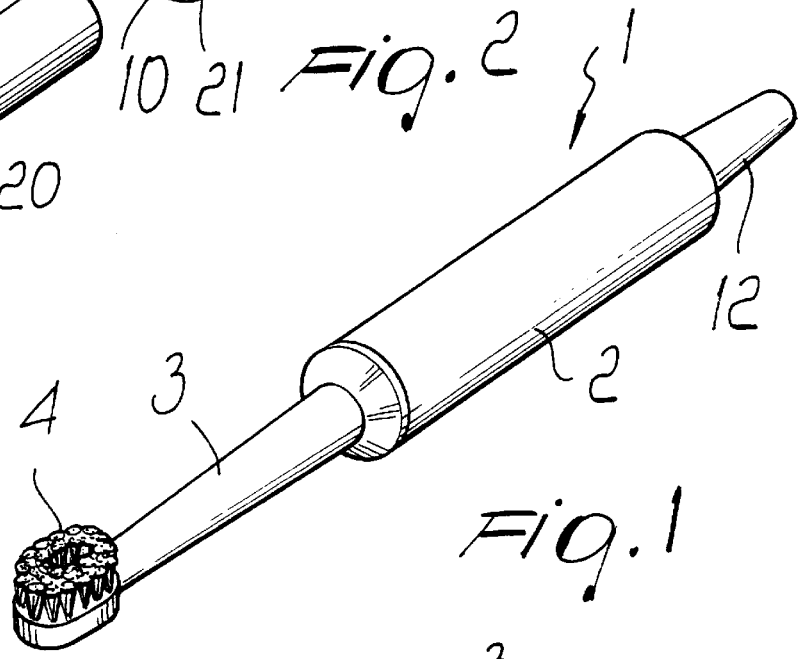
FIG. 1 is a schematic perspective view of the device.
Figure 6:
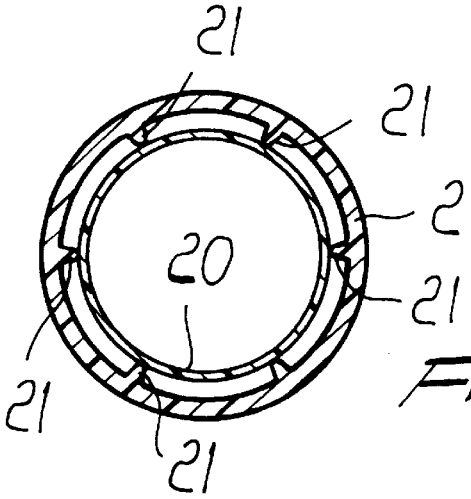
FIG. 6 is a sectional view, taken along the plane VI—VI of FIG. 3.
Figure 5:
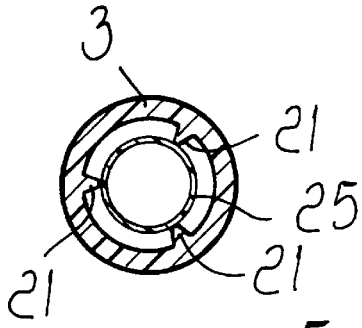
FIG. 5 is a sectional view, taken along the plane V—V of FIG. 3.
Figure 3:
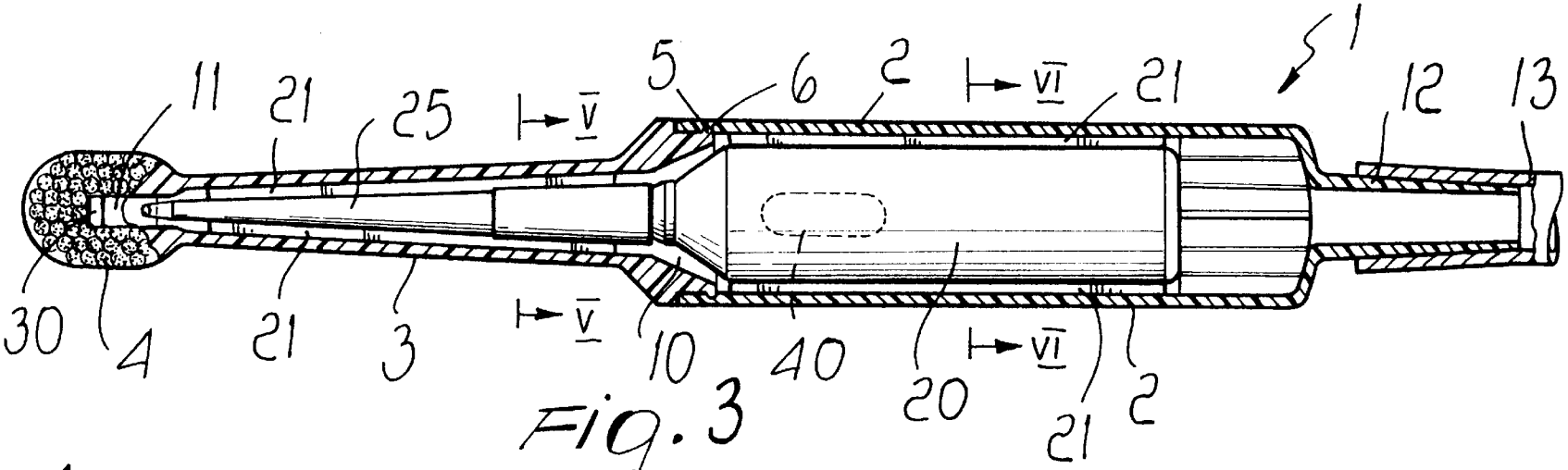
FIG. 3 is a longitudinal sectional view of the device.
Figure 4:
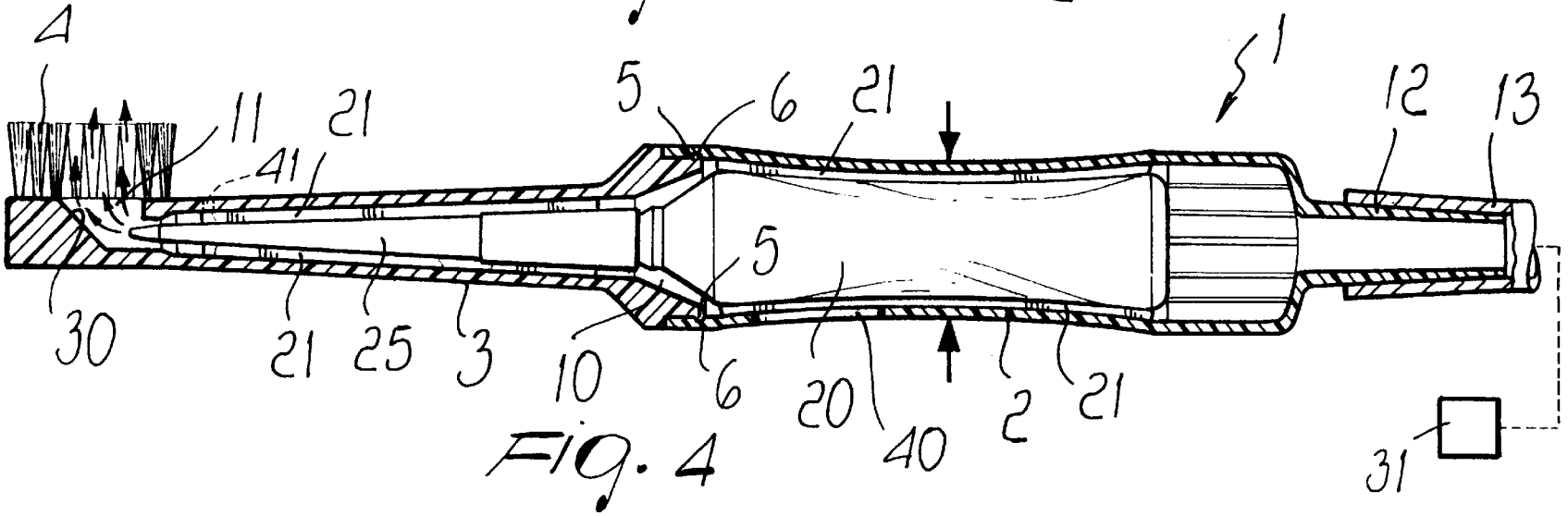
FIG. 4 is a longitudinal sectional view of the device, turned through 90° with respect to FIG. 3 and with the container body compressed in order to dispense the cleaning liquid.

With reference to the above figures, the oral cavity cleaning device particularly for bedridden patients according to the invention comprises a body, generally designated by the reference numeral 1, which advantageously consists of a grip element 2 to which a front portion 3 is connected, said front portion ending with a region which is affected by cleaning means such as bristles 4 or in any case by any element that can be used to clean the oral cavity.

The front portion 3 can be coupled, so as to form a liquid-tight coupling, to the grip portion 2 and for this purpose it is provided with a protruding rim 5 which fits snugly in a corresponding groove 6 provided in the grip portion 2; the tight coupling can also be provided with different means, such as for example a threaded coupling or a bayonet engagement.

A through channel 10 is formed inside the grip portion 2 and the front portion 3 and ends, at the front portion, with an opening 11 which is arranged among the bristles 4, while at the rear end of the grip portion the channel 10 leads into an inlet 12 which can be connected to a suction unit 31, for example, by means of a flexible hose designated by the reference numeral 13.

The particularity of the invention consists in that the channel 10 can accommodate a liquid container 20, which is retained inside the channel 10 by means of ribs 21 which protrude longitudinally and in practice do not interrupt the continuity of the channel 10, leaving an annular passage for the aspiration fluid.

The container body 20 is preferably provided with a nozzle 25 which is accommodated inside the front portion 3 and is retained in position by ribs, again designated by the reference numeral 21, which leave free an annular gap in order to allow the passage of aspiration fluid inside the channel 10.

The dispensing nozzle 25 ends proximate to the opening 11, where is advantageously provided a deflector surface 30 which is meant to convey outward, substantially parallel to the orientation of the bristles, the flow of liquid discharged by the container body.

The liquid is dispensed by acting outside the body 1 and advantageously both the grip portion 2 and the liquid container 20 are made of flexible material, so that by producing a radial compression on the outside of the grip element 2 one achieves the compression of the liquid container 20, consequently dispensing the liquid externally.

The liquid can be obtained by means of water and the like or with a physiological solution, optionally with the addition of medical products of any kind. The liquid could further be disinfectant, antibacterial, cleansing, sanitating or otherwise therapeutical.

It is most important that the amount of liquid inside the container 20 is pre-dosed and accordingly the user is perfectly aware of the amount of liquid that he introduces into the oral cavity of the patient, accordingly avoiding problems, such as swallowing the liquid, which would be extremely dangerous in non-autonomous patients.

The liquid container can be of the disposable type or can be optionally recycled to be filled with the amount of liquid deemed appropriate.

Furthermore at the grip body there is provided a through opening 40 which, when left open, is designed to prevent suction from occurring at the bristle region, for example during liquid dispensing; said opening, can be closed simply by the user's finger, so as to cause suction to occur exactly in the bristle region, thus achieving direct removal at the region where the brush is operated.

From the above description it is thus evident that the invention achieves the intended aim and objects, and in particular the fact is stressed that the use of a liquid container located directly inside the grip body allows to use just one hand to dispense the liquid and sucking it; moreover it is possible to direct the cleaning liquid exactly in the brush work area.

Further advantage derives from the fact that there is avoided the use of external sources of liquids, whose dosage and administration is quite often complicated.

A further important aspect of the invention consists in that it is possible to introduce, optionally, medical products, directly in the liquid container, thus facilitating practices required for correct oral hygiene.

The invention thus conceived is susceptible of numerous modifications and variations, all of which are within the scope of the inventive concept.

Thus, e.g. a suction opening 41 can be foreseen, which is separated from the liquid dispensing nozzle 25, in order to prevent mixing between the fresh dispensed liquid and the used liquid which is being sucked.

All the details may furthermore be replaced with other technically equivalent elements.

In practice, the materials used, as well as the dimensions and the contingent shapes, may be any according to requirements.

The disclosures in Italian Patent Application No. MI98A002214 from which this application claims priority are incorporated herein by reference.

What is claimed is:

1. An oral cavity cleaning device, particularly for bedridden patients, comprising a suction unit; a body which has a grip portion; an additional front portion connected to said grip portion; cleaning means provided at said front portion for cleaning the oral cavity; a through channel being formed inside said body, said channel having, at a first end thereof, an opening located at said cleaning means and, at a second opposite end, an inlet, said inlet being connectable to said suction unit; and, inside said through channel, a container with a liquid, said container being operatable from the outside of said body for spraying said liquid through said opening; fluid tight means for connecting in a fluid tight manner said front portion to said grip portion; internal ribs provided at said grip and front portions for peripherally supporting said container inside said grip portion so as to form an annular region of said channel for passage of fluid aspirated by said suction unit in said channel.

2. The device of claim 1, comprising a nozzle element which is connected to said liquid container and is accommodatable in said front portion.

3. The device of claim 2, wherein said cleaning means are constituted by bristles, the device further comprising, in said channel, proximate to said opening, an inclined redirection surface for conveying the liquid dispensed from said container in a direction which is substantially parallel to said bristles.

4. The device of claim 2, wherein said nozzle element is detachably connected to said liquid container.

5. The device of claim 4, comprising, on said grip portion, an opening which is temporarily closable by a user's finger.

6. The device of claim 5, comprising a suction opening which is provided separated from said dispensing nozzle of the container.

* * * * *